United States Patent [19]

Schubert

[11] 4,116,428

[45] Sep. 26, 1978

[54] APPARATUS FOR SEPARATING LOWERMOST SHEETS FROM A STACK

[75] Inventor: Bernhard Schubert, Neu Börnsen, Fed. Rep. of Germany

[73] Assignee: Hauni-Werke Körber & Co. KG., Fed. Rep. of Germany

[21] Appl. No.: 636,580

[22] Filed: Dec. 1, 1975

[30] Foreign Application Priority Data

Nov. 30, 1974 [DE] Fed. Rep. of Germany ..... 2456701
Dec. 7, 1974 [DE] Fed. Rep. of Germany ..... 2458056

[51] Int. Cl.[2] ..... B65H 5/08

[52] U.S. Cl. ..... 271/14; 271/92; 271/95; 271/101; 271/102; 271/104; 271/106

[58] Field of Search ..... 271/91, 95, 99, 100, 271/101, 104, 106, 92, 102, 14

[56] References Cited

U.S. PATENT DOCUMENTS

| | | | |
|---|---|---|---|
| 789,095 | 5/1905 | Juengst | 271/100 |
| 1,053,781 | 2/1913 | Brown | 271/100 X |
| 1,335,556 | 3/1920 | Clark | 271/100 X |
| 3,069,158 | 12/1962 | Engleson | 271/101 X |
| 3,322,301 | 5/1967 | Bliss | 271/106 X |
| 3,380,353 | 4/1968 | Mittermayer | 271/100 X |
| 3,627,309 | 12/1971 | Ganz | 271/101 X |

*Primary Examiner*—Richard A. Schacher
*Attorney, Agent, or Firm*—Peter K. Kontler

[57] ABSTRACT

The lowermost sheet of an upright stack of superposed sheets is removed by a device which has one or more suction heads and is moved against the underside of the lowermost sheet prior to folding one or two marginal portions of such sheet downwardly to separate the marginal portions from the adjacent portions of the next-to-the-lowermost sheet. The device thereupon moves the lowermost sheet downwardly, substantially at right angles to the plane of the next-to-the-lowermost sheet, either into the range of one or more tongs or analogous transfer elements, or directly to the periphery of a rotary turret in a cigarette packing machine. Once the marginal portion or portions of the lowermost sheet are flexed downwardly, the corresponding marginal portion or portions of the next-to-the-lowermost sheet are engaged and held by one or more pivotable retaining members which are disengaged from the sheet as soon as the device returns to its raised position and attracts and supports the next lowermost sheet.

7 Claims, 21 Drawing Figures

125
126
127
122
118
120
113
117
116
124
123
131
114
111
119
101
110
112
106
108
133
146
129
144
132
102
141
143
139
138
136
134

APPARATUS FOR SEPARATING LOWERMOST SHEETS FROM A STACK

BACKGROUND OF THE INVENTION

The present invention relates to apparatus for removing successive lowermost sheets from a stack of superposed sheets, especially from a substantially vertical stack of sheets which can be converted into constituents of packs or analogous containers for cigarettes or other smokers' products. Typical examples of such sheets are revenue labels and blanks which latter can be converted into inner, intermediate or outer envelopes of various types of cigarette packs including those known as soft packs as well as the so-called flip-top or hinged-lid packs.

German Pat. No. 962, 869 discloses a method and apparatus for removing successive lowermost sheets from an upright stack or superposed sheets which are stored in a magazine. The patented apparatus includes means for flexing one or two marginal portions of the lowermost sheet away from the corresponding marginal portions of the next-to-the-lowermost sheet of the stack, and means for moving the thus deformed lowermost sheet sideways, i.e., at right angles to the longitudinal directions of deformed marginal portions. Such movement of the lowermost sheet, in a plane which is parallel to the plane of the next-to-the-lowermost sheet, does not present serious problems when the sheets are smooth. However, the just described method and apparatus cannot be used for removal of successive lowermost sheets from a stack wherein the sheets exhibit unevennesses, such as fold lines, notches, slits or the like, because neighboring sheets are likely to be interlaced with each other so that sidewise movement of the lowermost sheet often results in sidewise movement of one or more sheets thereabove. Examples of just discussed sheets are blanks which are made of stiff paper, lightweight cardboard or synthetic plastic sheet material and are to be converted into outer envelopes of flip-top packs. Such blanks are formed with longitudinally and transversely extending fold lines whereby the ridges at one side of one blank are likely to enter the grooves at the adjacent side of the neighboring blank. Also, those portions of the blanks which are formed with slits or notches are highly likely to become interlaced with similar portions of neighboring blanks. The situation is aggravated when the surrounding atmosphere contains a relatively high percentage of moisture; this causes the neighboring blanks to adhere to each other so that a sidewise movement of the lowermost blank of a stack of blanks invariably results in undersirable shifting or complete evacuation of the next-to-the-lowermost blank (or two or more blanks above the lowermost blank). Any shifting or premature evacuation of blanks which form the stack can entail lengthy interruptions in operation of the packing machine with attendant substantial losses in output.

Unrelated but equally serious problems arise in connection with removal of successive lowermost sheets which constitute revenue labels and are to be applied across the tops of successive cigarette packs. The labels are relatively small and narrow. Therefore, and since the labels are normally removed by shifting them lengthwise, the distance which the removing instrumentalities must cover in order to separate the lowermost label from the next-to-the-lowermost label is relatively long; this is undesirable because the intervals between removal of successive lowermost labels are also long. Sidewise shifting of labels is even less satisfactory because the labels are narrow and, therefore, the dimensions of removing devices must be reduced to a value at which such devices are incapable of securely grasping the labels during shifting out of register with the labels thereabove.

OBJECTS AND SUMMARY OF THE INVENTION

An object of the invention is to provide an apparatus which can be placed so close to selected sheet processing units in a cigarette packing or like machine that such units can receive sheets directly from the component parts of the improved apparatus.

An additional object of the invention is to provide an apparatus which can reliably remove discrete sheets from the bottom of a stack or superposed sheets and which can remove the lowermost sheets without any shifting and/or deformation of the next-to-the-lowermost sheet.

Still another object of the invention is to provide the apparatus with novel and improved sheet removing means.

A further object of the invention is to provide an apparatus which, though especially suited for removal of relatively narrow sheets (such as revenue labels for application to cigarette packs) or for removal of sheets which exhibit fold lines, slits and notches (such as paper, cardboard or plastic blanks which are to be converted into outer envelopes of so-called flip-top cigarette packs), can be used with equal advantage for removal of other types of stiff, readily flexible, large, small, metallic, fibrous or other sheets.

The invention resides in the provision of apparatus for removing the lowermost sheet of a stack of superposed sheets, especially a vertical or nearly vertical stack of sheets which are to be converted into constituents of packs or analogous containers for cigarettes or other smokers' products. The apparatus comprises means for of flexing at least one marginal portion of the lowermost sheet downwardly and away from the next-to-the-lowermost sheet of the stack so that the lowermost and next-to-the-lowermost sheets become at least partially separated from each other, and thereupon moving the lowermost sheet downwardly in a direction which is substantially or exactly normal to the plane of the next-to-the-lowermost sheet of the stack.

In many instances, the superposed sheets of the stack are rectangular or square so that the one marginal portion of each sheet is located opposite and is at least substantially parallel to a second marginal portion. The flexing means then comprises, or may comprise, means for flexing the one and the second marginal portion of the lowermost sheet downwardly and away from the neighboring marginal portions of the next-to-the-lowermost sheet of the stack. The apparatus may further comprise means for supporting the marginal portions of the lowermost sheet from below prior to the flexing step, for thereupon supporting the lowermost sheet from below intermediate the two marginal portions prior to and in the course of the flexing step while interrupting the supporting action upon the marginal portions so as to enable the marginal portions of the lowermost sheet to be flexed downwardly, and for thereupon supporting from below the one and the second marginal portion of the next-to-the-lowermost sheet in the course of the moving step to thus prevent the next-to-the-lowermost sheet from sharing the downward movement of the lowermost sheet. The just described apparatus can be used with advantage for removal of sheets which are formed with fold lines, slits, cutouts or the like and are thus likely to be interlaced with each other while forming part of the stack.

The one and/or the second marginal portion of the lowermost sheet may but need not be flexed through 90 degrees, and the moving means may comprise means for pivoting the lowermost sheet about an axis which is remote from the lowermost sheet and is at least substantially parallel to the plane of the next-to-the-lowermost sheet (such axis may be parallel to the one and/or second marginal portion of the lowermost sheet). The action of the flexing means may be terminated in the course of or subsequent to the moving step so that the one marginal portion is again located in the general plane of the lowermost sheet (this can be achieved by flexing the one marginal portion back into the general plane of the lowermost sheet or by flexing the remainder of the lowermost sheet into the general plane of the one marginal portion). At least one of the flexing and moving means may comprise means for reducing the air pressure at the underside of the lowermost sheet to below atmospheric pressure (this can be achieved by using flexing and/or moving means which constitute or include suction heads).

The lowermost sheet can be conveyed along a arcuate path, e.g., by a turret or drum, immediately following the moving step. Alternatively, the lowermost sheet can be taken over by one or more tongs and transported from the removing device to a turret or an analogous conveyor which may be driven continuously or in stepwise fashion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

Figure 1:
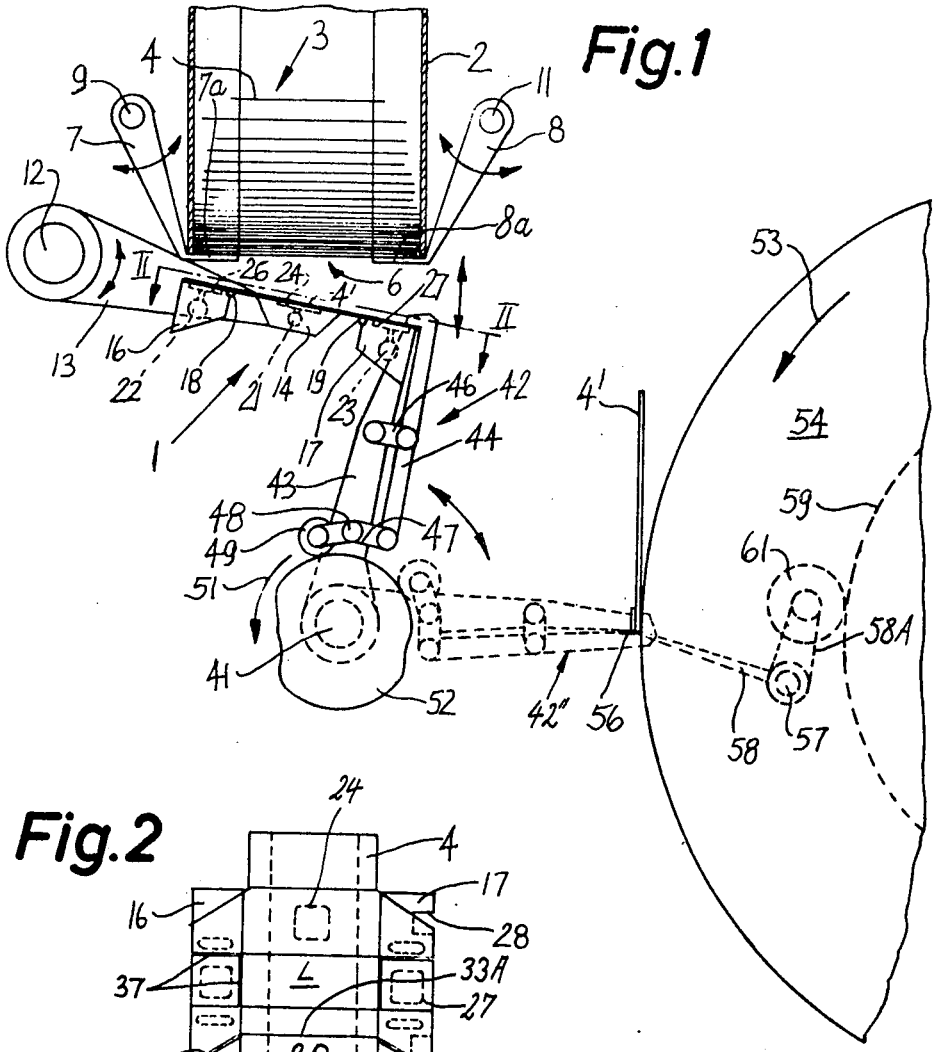
FIG. 1 is a partly elevational and partly vertical sectional view of an apparatus which embodies one form of the invention, further showing a portion of a conveyor which indirectly receives successive sheets from the sheet removing device of the apparatus.
Figure 4:
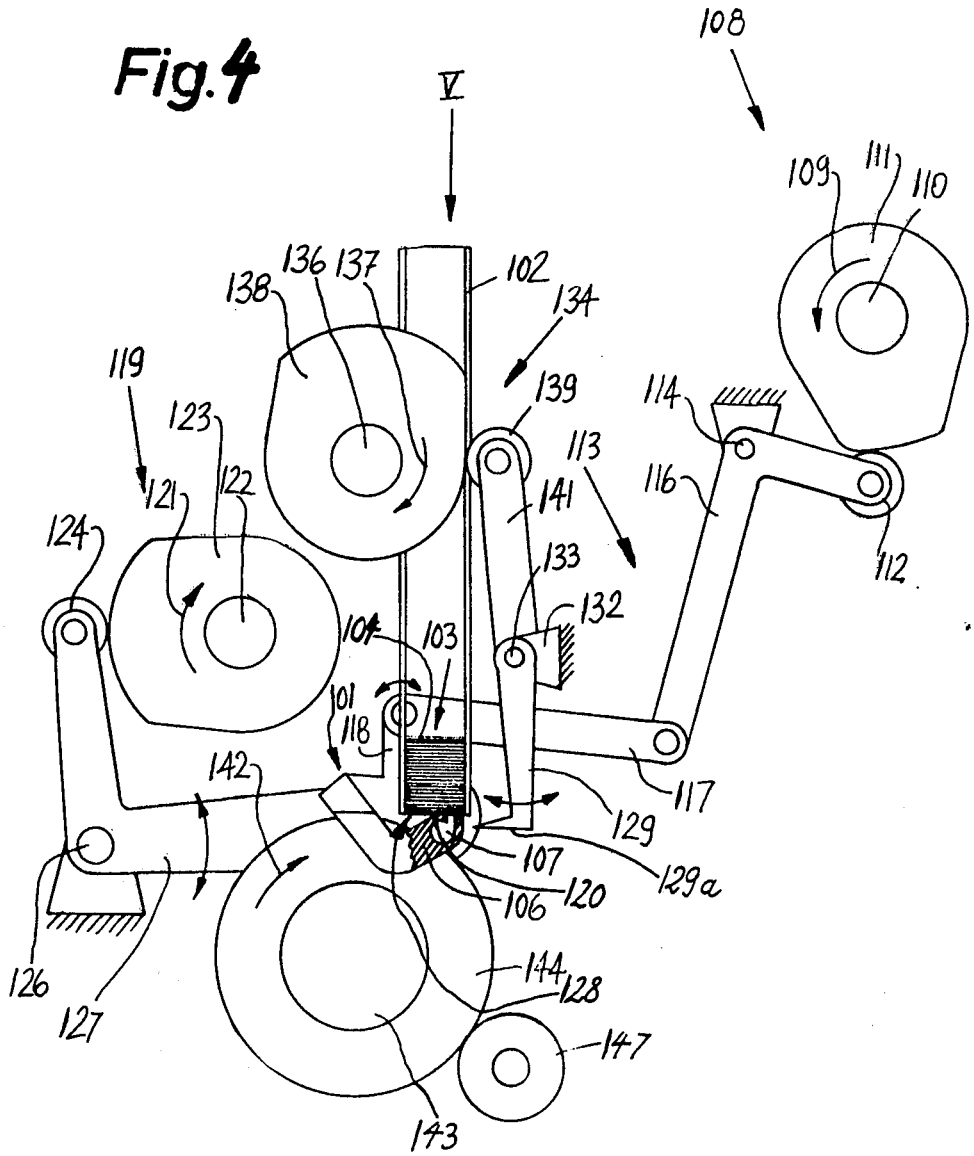
Figure 5:
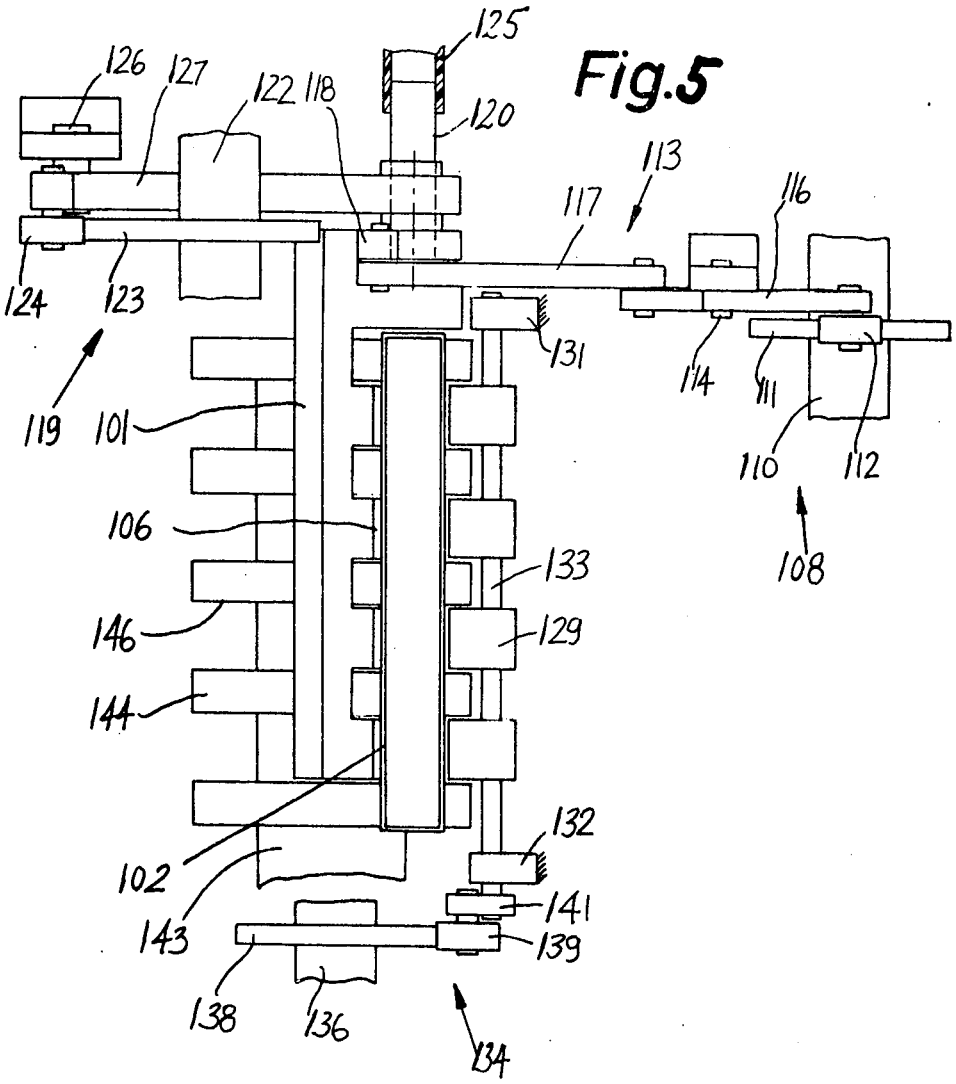

FIGS. *3a, 3b, 3c, 3d, 3e, 3f, 3g* and *3h* illustrate various stages of removal and further manipulation of the lowermost sheet of a stack of superposed sheets in the magazine of the apparatus shown in FIG. 1;

FIG. 4 is a schematic elevational view of a modified apparatus;

FIG. 5 is a plan view substantially as seen in the direction of arrow V in FIG. 4;

FIGS. *5a, 5b* and *5c* show three different positions of the means for moving the sheet removing device in the apparatus of FIGS. 4 and 5; and FIGS. *6a, 6b, 6c, 6d, 6e* and *6f* illustrate various stages of removal and further manipulation of the lowermost sheet of a stack of sheets in a magazine forming part of the apparatus shown in FIGS. 4 and 5.

DESCRIPTION OF THE PREFERRED EMBODIMENTS

Figure 2:
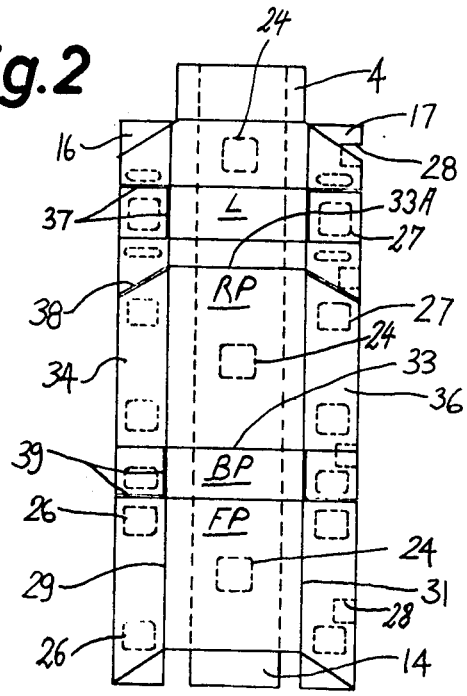
FIG. 2 is a plan view of a sheet and of a portion of the removing device, substantially as seen in the direction of arrows from the line II—II of FIG. 1.

FIG. 1 shows an apparatus which forms part of a packing machine for cigarettes or other rod-shaped smokers' products. The machine may be of the type disclosed in the commonly owned copending application Ser. No. 529,485 of F. Kruse et al., filed Dec. 4, 1974. A magazine 2 or an analogous receptacle stores an upright stack 3 of discrete sheets 4 each of which may be configurated in a manner as shown in FIG. 2. Such sheets can be used as blanks for conversion into outer envelopes of so-called soft packs or flip-top (hinged-lid) packs for arrays of cigarettes, cigarillos or cigars. It is assumed that the sheets 4 consist of relatively stiff paper or lightweight cardboard and constitute blanks for conversion into outer envelopes of flip-top packs for plain or filter tipped cigarettes. The lower end of the magazine 2 has an outlet opening 6 and the lowermost sheet 4 of the stack 3 in the magazine rests on the bent-over portions or prongs *7a, 8a* of two pivotable retaining members 7, 8 mounted on parallel horizontal shafts 9, 11. The retaining members 7, 8 are pivotable between the illustrated operative positions and inoperative positions (see, for example, FIG. *3c*) in which their prongs *7a, 8a* are out of register with the opening 6.

The apparatus of FIG. 1 further comprises a sheet removing device 1 and a moving means for the removing device. The moving means includes a carrier or arm 13 pivotable about the axis of a horizontal shaft 12 which is parallel to the shafts 9 and 11. The arm 13 is pivotable to and from the illustrated (lower end) position and supports a centrally located sheet supporting first element 14 flanked by two mobile sheet flexing elements 16, 17 of the device 1. The flexing elements 16, 17 are respectively pivotable about pivot members 18, 19 which are mounted on the arm 13 and are parallel to the shaft 12 (i.e., normal to the plane of FIG. 1). A comparison of FIGS. *3c* and *3d* will indicate that the flexing elements 16, 17 are pivotable in opposite directions through approximately or exactly 90 degrees. The elements 14, 16, 17 are suction heads which are respectively formed with suction channels 21, 22, 23 extending at right angles to the plane of FIG. 1 and with suction ports 24, 26, 27. The suctions ports 24, 26, 27 constitute means for maintaining the lowermost sheet of the stack 3 in contact with the elements 14, 16, 17 of the removing device 1. The suction port 24 of the supporting element 14 is open at its upper end so that its air intake is immediately adjacent to the underside of the lowermost sheet of the stack 3 when the arm 13 is caused to pivot in a counterclockwise direction, as viewed in FIG. 1, so as to move the supporting element 14 to the first position shown in FIG. *3b*. In such position, the upper side or surface 14A of the supporting element 14 supports the lowermost sheet 4' of the stack 3 irrespective of whether the retaining members 7, 8 are held in their operative or inoperative positions. As a rule, the elements 14, 16, 17 will be formed with several suction ports 24, 26, 27 (see FIG. 2). Furthermore, one side of the flexing element 17 is formed with at least one but preferably two or more lateral recesses or notches 28 (see FIG. 2).

Figure 3A:
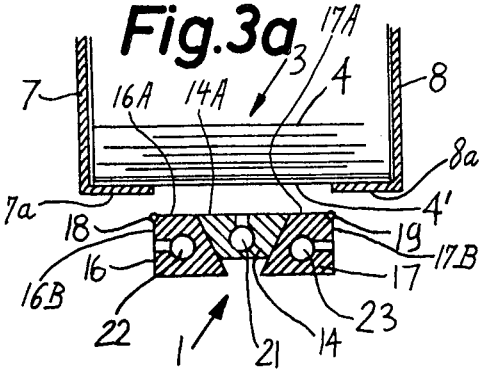
Figure 3B:
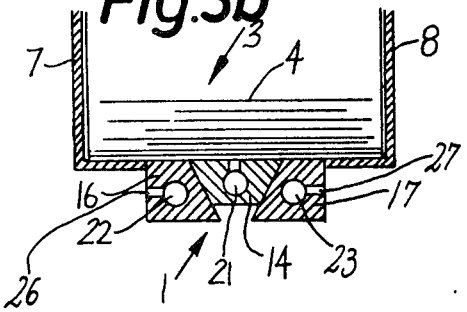
Figure 3C:
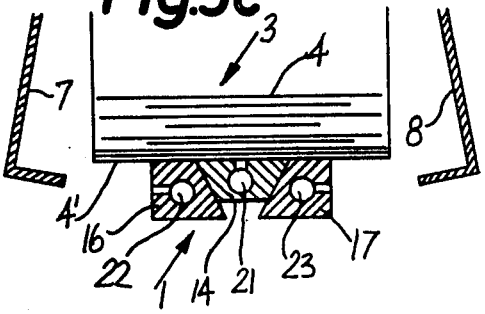
Figure 3D:
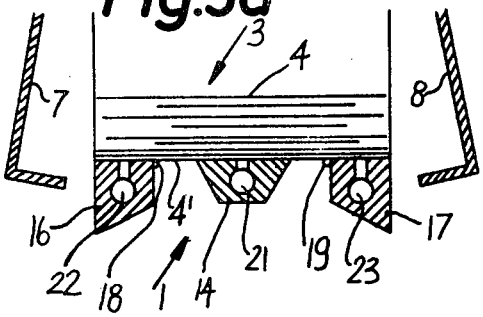
Figure 3E:
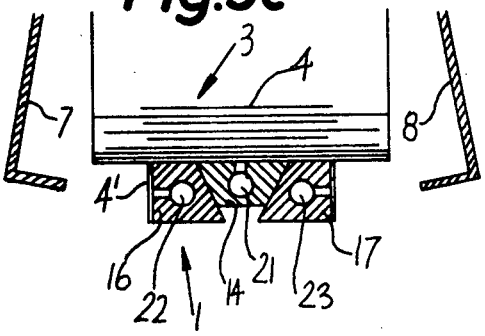
Figure 3F:
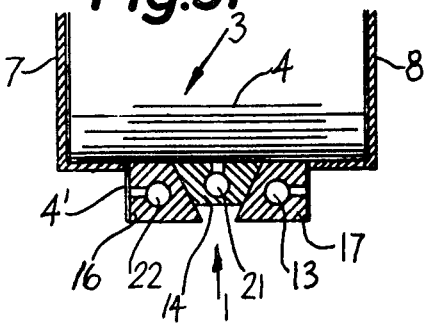
Figure 3G:
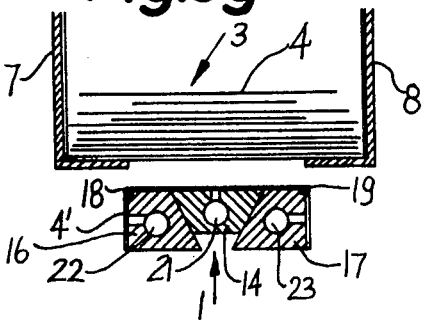
Figure 3H:
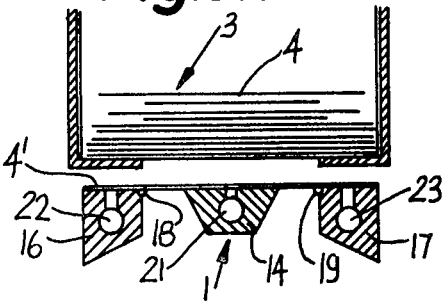

The flexing elements 16, 17 have first sides or surfaces 16A, 17A which are flush with the surface 14A when the elements 16, 17 assume the angular positions shown in FIG. *3a, 3b, 3c, 3e, 3f* or *3g*, and second sides or surfaces 16B, 17B which are flush with the surface 14A when the elements 16, 17 assume the angular positions shown in FIGS. 3*d* and 3*h*. When the surfaces 16A, 17A are flush with the surface 14A, the flexing elements 16, 17 are immediately adjacent to the supporting element 14 and the combined width of surfaces 16*a*, 14A, 17A (as considered at right angles to the axis of the shaft 12) is at least slightly less than the distance between the prongs 7*a*, 8*a* in operative positions of the retaining members 7, 8 so that the arm 13 can lift the elements 14, 16, 17 into abutment with the underside of the lowermost sheet 4' of the stack 3 while the prongs 7*a*, 8*a* of the retaining members 7, 8 engage two parallel marginal portions of such sheet. The flexing elements 16, 17 can pivot to the positions shown in FIG. 3*d* or 3*h* subsequent to movement of retaining members 7, 8 to their inoperative positions because the elements 16, 17 are spaced apart from the supporting element 14 when the surfaces 16B, 17B are flush with the surface 14A. The ports 26, 27 are machined into the surfaces 16B, 17B, i.e., the surfaces 16B, 17B can attract the adjacent marginal portions of the lowermost sheet 4' of the stack 3 while the median portion of such sheet rests on the surface 14A and is supported by the element 14.

The sheet 4 of FIG. 2 has two longitudinally extending parallel fold lines 29, 31 and several transversely extending fold lines 33. Those marginal portions or flaps (34, 36) of the sheet 4 which are outwardly adjacent to the respective fold lines 28, 29 are formed with suitably configurated slits 37, 38 and 39 which enable the packing machine to convert the sheet 4 into an outer envelope having a front panel FP, a bottom panel BP, a rear panel RP, and a lid L which is pivotable with respect to the rear panel RP along the fold line 33A. The two flaps 34, 36 of the sheet 4 can be converted into lateral panels of the envelope.

The apparatus of FIG. 1 further comprises several sheet transferring devices or tongs 42, one for each notch 28 of the mobile flexing element 17. Each of these tongs is pivotable about the fixed axis of a horizontal shaft 41 and each thereof comprises a fixed portion or blade 43 and a second portion or blade 44 which is movable lengthwise of the associated blade 43. The blades 43, 44 of each tongs 42 are coupled to each other by two pivotable links 46 and 47. The link 47 is turnable on a pivot pin 48 of the blade 43 and one of its ends carries a roller follower 49 which tracks the periphery of a rotary disk-shaped cam 52. The latter is driven to rotate in the direction indicated by arrow 51.

The tongs 42 serve to accept successive sheets 4' from the elements 14, 16, 17 and to transfer the thus accepted sheets onto a conveyor 54 here shown as a turret which is advanced in stepwise fashion to rotate in the direction indicated by arrow 53. The periphery of the turret 54 has L-shaped stops 56 for the leading edges of successive sheets 4'. Furthermore, the turret 54 supports several clamping devices 58, one for each stop 56, which are pivotable on discrete pins 57 mounted in or on the turret 54. The clamping devices 58 have arms 58A which carry roller followers 61 tracking the periphery of a disk-shaped cam 59. The exact manner in which the retaining members 7, 8 and arm 13 are pivotable about the axes of the respective shafts, in which the flexing elements 16, 17 are pivotable about the respective shafts 18, 19, and in which the cam 52 and turret 54 are rotated is not shown in FIG. 1; suitable means which can effect such movements will be described with reference to the second embodiment which is shown in FIGS. 4 and 5.

The operation:

FIG. 3*a* shows the sheet removing device 1 in an intermediate position in which the elements 14, 16, 17 are still spaced apart from the lowermost sheet 4' of the stack 3 in the magazine 2. The flexing elements 16, 17 are immediately adjacent to the supporting element 14 and their surfaces 16A, 17A are flush with the surface 14A. The lowermost sheet 4' is engaged by the prongs 7*a*, 8*a* which are long enough to insure that the central portion of the stack 3 will not buckle (i.e., that the underside of the lowermost sheet 4' remains flat in the space between the two prongs). The arm 13 is pivoted in a counterclockwise direction, as viewed in FIG. 1, in order to move the elements 14, 16 and 17 to the positions shown in FIG. 3*b*. The central portion of the underside of the sheet 4' (and hence the entire stack 3) rests on the surfaces 16A, 14A, 17A which are assumed to be flush or substantially flush with the upper sides of the prongs 7*a*, 8*a*.

The retaining members 7, 8 are thereupon pivoted to the inoperative positions shown in FIG. 3*c* so that the stack 3 rests exclusively on the surfaces 16A, 14A and 17A. In the next step, the flexing elements 16, 17 are pivoted through 90° (about the respective shafts 18, 19) to assume the positions shown in FIG. 3*d* in which the marginal portions (flaps 34, 36) of the sheet 4' are in contact with the surfaces 16B, 17B and are attracted by the respective suction ports 26, 27 while the suction ports 24 of the supporting element 14 attract the central portion (panels FP, BP, RP and lid L) of the sheet 4'. The channels 21, 22, 23 can be connected with the suction generating means in response to or simultaneously with pivoting of flexing elements 16, 17 from the positions of FIG. 3*c* to those shown in FIG. 3*d*.

In the next step (FIG. 3*e*), the flexing elements 16, 17 are pivoted back to the positions shown in FIG. 3*c*; however, the channels 22, 21, 23 remain connected to the suction generating means so that the flaps 34, 36 adhere to the surfaces 16B, 17B and are pivoted downwardly into planes which are normal or substantially normal to the common plane of the panels FP, BP, RP and lid L. The flaps 34, 36 respectively pivot along the longitudinally extending fold lines 29, 31. Such pivoting of the flaps 34, 36 prior to detachment of the sheet 4' from the next-to-the-lowermost sheet 4 of the stack 3 is desirable and advantageous because the flap portions of sheet 4' which are formed with the slits 37, 38, 39 are likely to be entangled or interlaced with the ajacent portions of the next-to-the-lowermost sheet 4.

The retaining members 7, 8 are thereupon pivoted back to the operative positions (see FIG. 3*f*) so that their prongs 7*a*, 8*a* engage and support the marginal portions (flaps) of the next-to-the-lowermost sheet 4 immediately above the lowermost sheet 4' of the stack 3. In the next step, the arm 13 is caused to pivot clockwise, as viewed in FIG. 1, so as to move the elements 14, 16, 17 to the positions shown in FIG. 3*g*. The channels 21, 22, 23 continue to communicate with the intake of the suction generating means so that the partially deformed lowermost sheet 4' shares the downward movement of removing device 1. The tongs 42 can remove a deformed sheet 4' (i.e., a sheet having the shape shown in FIG. 3*g*) or the flexing elements 16, 17 of the removing device 1 can be pivoted to the positions shown in FIG. 3*h* so as to return the flaps 34, 36 into the plane of the panels FP, BP, RP and lid L. The positions of elements 14, 16, 17 shown in FIG. 3*h* correspond to those of FIG. 1. The cam 52 thereupon causes the jaws of the blades 43 to enter the neighboring notches 28 of the flexing element 17 while the jaws of the blades 44 are located above the flap 36. As the cam 52 continues to rotate, it causes the blades 44 to move downwardly, as viewed in FIG. 1, so that the flap 36 is engaged by the jaws of associated blades 43, 44 before the tongs 42 are pivoted to the broken-line positions 42" of FIG. 1. The lower edge portion of the flap 36 then rests on the adjacent stop 56 of the turret 54 and is engaged by the respective clamping device 58 which is actuated by the cam 59. The tongs 42 continue to pivot clockwise beyond the positions 42" of FIG. 1 and the jaws of their blades 43, 44 become separated so that they release the flap 36 which is thereupon held only by the respective clamping device or devices 58. The manner in which the sheet 4' is thereupon converted into the outer envelope of a flip-top pack for cigarettes forms no part of the invention; such conversion may involve applying adhesive to selected portions of the sheet 4', folding the flaps 34, 36, and folding the panels and portions of the lid along the corresponding fold lines 33. The outer envelope can be formed around an inner envelope which contains an array of plain or filter cigarettes, or the inner envelope and the cigarettes can be inserted subsequent to completed conversion of sheet 4' into an outer envelope.

FIGS. 4 and 5 show a second apparatus which is embodied in a cigarette packing machine and comprises a modified sheet removing device 101 serving to remove sheets 104 from the underside of a stack 103 which is stored in a magazine 102. The sheets 104 are assumed to constitute relatively long and relatively narrow revenue labels each of which is to be applied about one end of a cigarette pack so that the label must be destroyed before the purchaser can gain access to cigarettes. The removing device 101 comprises a row of suction heads 106 which are movable as a unit and have suction channels 107 adapted to be connected to a suitable suction generating device (e.g., a fan, not shown) by way of a flexible conduit or hose 125. The suction ports 107A (see FIG. 6*a*) of the suction heads 106 communicate with the respective channels 107 and extend inwardly from the sides or surfaces 106A (FIG. 6*b*) of the corresponding suction heads.

The apparatus further comprises first and second units 108, 119 for moving the suction heads 106 with respect to the magazine 102. The first moving unit 108 includes a rotary disk-shaped cam 111 mounted on a shaft 110 and being rotatable in the direction indicated by arrow 109. The periphery of the cam 111 is tracked by a roller follower 112 which is mounted at the free end of one arm of a bell crank lever 116 forming part of a motion transmitting linkage 113 and being pivotable about the axis of a stationary pin 114. The other arm of the bell crank lever 116 is articulately connected with a link 117 (see the pin 155 in FIGS. 5*a*–5*c*) which can rock a lever 118 by way of a pin 156. The latter is rigid with and transmits motion to a hollow shaft 120 for the removing device 101. The shaft 120 can move sideways.

The second moving unit 119 for the device 101 comprises a cam 123 which is rotatable about the axis of a shaft 122 in a clockwise direction, as viewed in FIG. 4 (see the arrow 121), and whose periphery is tracked by a roller follower 124 mounted at the free end of the upwardly extending arm of a motion transmitting means here shown as a bell crank lever 127. The lever 127 is pivotable about the axis of a fixed pin 126 and its other arm can transmit motion to the removing device 101. Such other arm is articulately connected to the shaft 120 which is rigid with the lever 118 of the moving unit 108 and serves as a nipple for the respective end of the hose 125.

The open lower end of the magazine 102 constitutes an outlet opening 128 immediately below the lowermost label 104 of the stack 103. Such lowermost label is normally held against movement through and beyond the opening 128 by a set of retaining members 129 having prongs 129*a* and being pivotable about the axis of a horizontal shaft 133. The shaft 133 is rigid with an arm 141 which carries a roller follower 139 tracking the periphery of a rotary disk-shaped cam 138. The cam 138 is mounted on a horizontal shaft 136 and is rotatable in the direction indicated by arrow 137. When the retaining members 129 dwell in the operative positions of FIGS. 6*c*, 6*d*, 6*e* or 6*f*, their prongs 129*a* hold the lowermost label 104 (and hence the entire stack 103) against downward movement with respect to the magazine 102. The shaft 133 for the retaining members 129 is rotatable in bearings 131, 132. The parts, 133, 141, 139 together constitute a drive 134 for moving the retaining members 129 between operative and inoperative positions.

The removing device 101 is mounted immediately or closely above a conveyor 144 which is driven to rotate in the direction indicated by arrow 142 and serves to accept successive sheets 104 from the device 101. The conveyor 144 is a roller or drum which is mounted on a shaft 143 and whose periphery is formed with suction ports (not specifically shown) to attract successive sheets 104 during transport of such sheets toward, past and beyond the roller-shaped applicator 147 of a conventional paster. The paster preferably comprises a tank for a supply of adhesive and a roller which dips into the supply of adhesive in the tank and applies a thin film of adhesive to the periphery of the applicator 147 so that the latter transfers adhesive to the exposed sides of successive sheets 104 on the conveyor 144. The thus coated sheets are thereupon applied to the adjacent ends of cigarette packs in a manner not forming part of the invention. Reference may be had to the aforementioned copending application of Kruse et al. The periphery of the conveyor 144 has circumferential grooves 146 which can receive the adjacent suction heads 106 of the removing device 101 whereby a sheet 104 is automatically separated from the suction heads and adheres to the periphery of the conveyor 144.

Figure 5A:
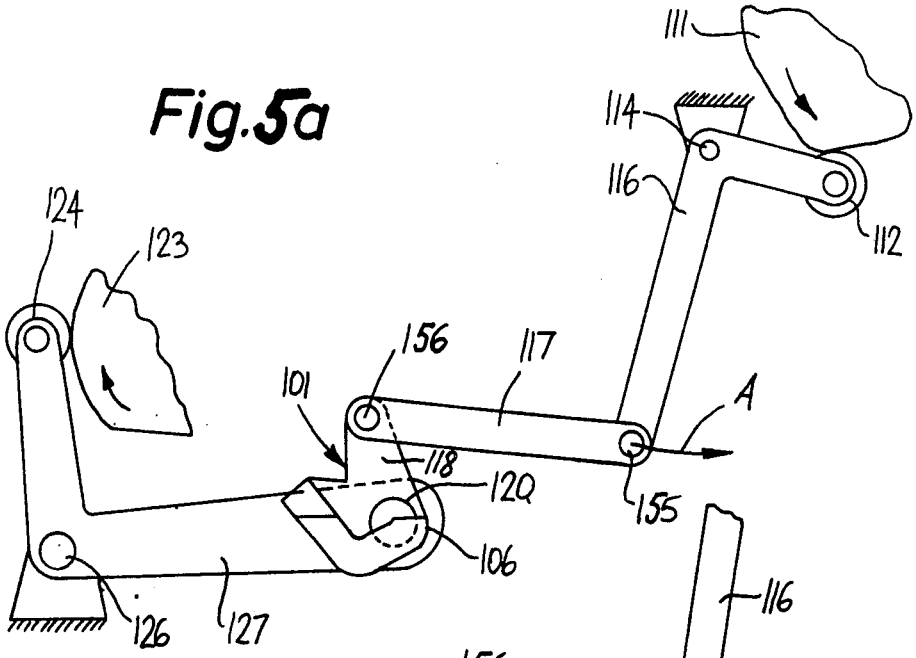
Figure 5B:
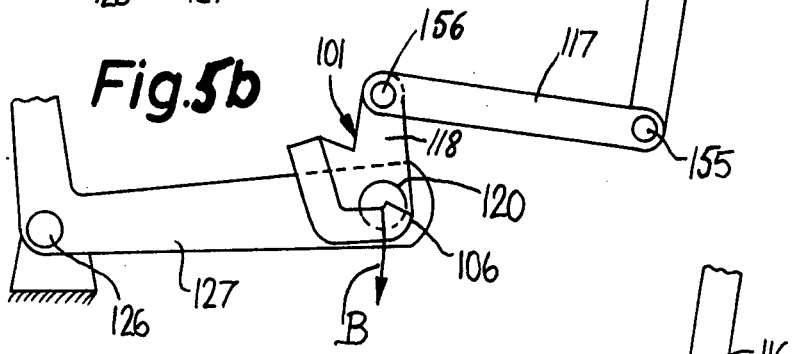
Figure 5C:
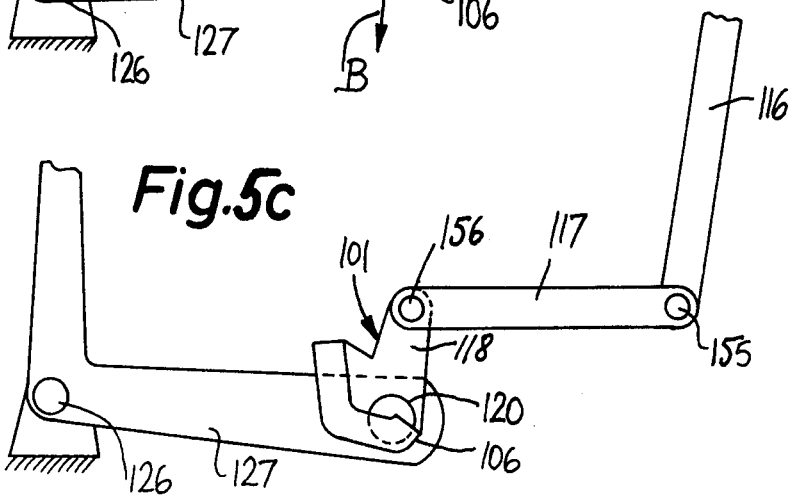

The manner in which the link 118 can turn the shaft 120 about the latter's axis and in which the lever 127 can move the shaft 120 sideways is shown in FIGS. 5*a*, 5*b* and 5*c*. When the cam 111 allows the lever 116 to pivot about the fixed axis of the pin 114 so as to move the pin 155 in the direction indicated by arrow A, the link 117 leaves the starting position of FIG. 5*a* and causes the link 118 to rotate the shaft 120 clockwise, as viewed in FIG. 5*a*. The suction heads 106 thereby pivot from the positions shown in FIG. 5*a* or FIG. 6*a* to those shown in FIGS. 5*b* or 6*b*. The cam 123 thereupon causes or allows the lever 127 to pivot clockwise, as viewed in FIG. 4, and to move the shaft 120 and suction heads 106 from the positions of FIGS. 5*b*, 6*b* or 6*c* to those shown in FIGS. 5*c* or 6*d*. The direction in which the lever 127 moves the shaft 120 sideways is indicated by the arrow B shown in FIG. 5*b*. The links 117, 118 pivot about the pins 155, 156 while the lever 127 pivots about the fixed axis of the pin 126. Such pivoting of links 118, 117 in response to pivoting of the lever 127 to the position shown in FIG. 5*c* results in a slight increase of inclination of the suction heads 106. This is desirable and advantageous because it facilitates the transfer of sheets 104' from the suction heads 106 onto the conveyor 144.

Figure 6A:
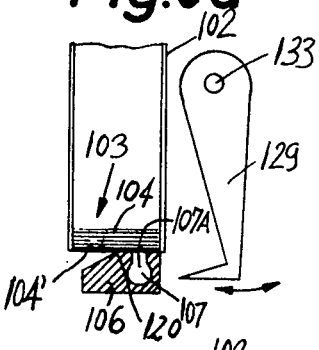
Figure 6B:
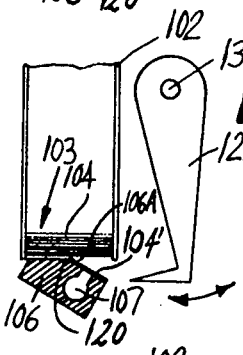
Figure 6C:
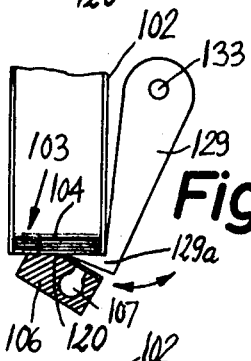
Figure 6D:
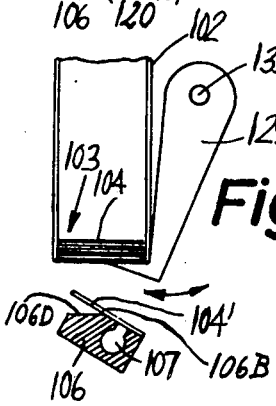
Figure 6E:
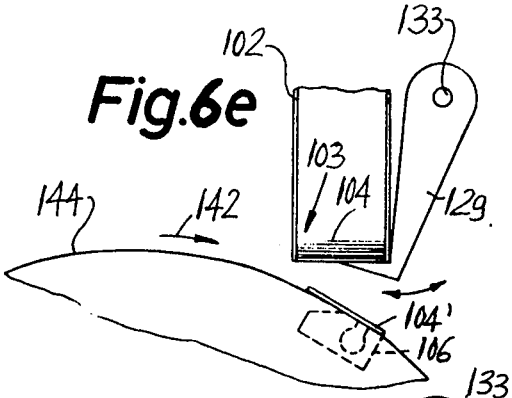
Figure 6F:
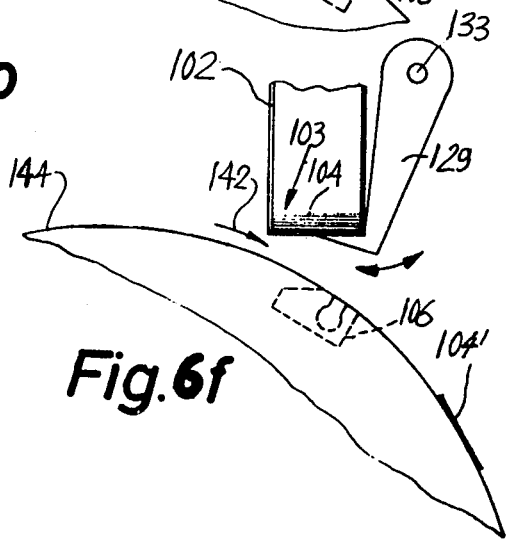

The operation of the apparatus of FIGS. 4-5*c* is as follows: FIGS. 4, 5*a* and 6*a* show the removing device 101 in a position (determined by the angular positions of cams 111, 123) in which the surfaces 106A of the suction heads 106 abut against the underside of the lowermost sheet 104' of the stack 103 and thus support the stack against downward movement with respect to the magazine 102. The ports 107A are connected to the suction generating means by way of the hose 125 so that the sheet 104' is attracted to the surfaces 106A.

The cam 111 is driven at a constant rate (arrow 109) and the link 118 causes the suction heads 106 to rotate about the axis of the shaft 120 whereby the suction heads 106 pivot with respect to the lever 127 and magazine 102 to thereby flex the right-hand marginal portion of the sheet 104' (as viewed in FIG. 6*b*) about ridges 106B between the surfaces 106A and second surfaces 106D (FIG. 6*d*) of the suction heads. In the meantime, the retaining members 129 dwell in the inoperative positions shown in FIGS. 6*a* and 6*b*. The downwardly flexed right-hand marginal portion of the lowermost sheet 104' remains flexed because it is attracted by the suction ports 107A of the suction heads 106. The prongs 129*a* of the retaining members 129 thereupon enter the thus developed wedge-like gap between the right-hand marginal portion of the sheet 104' and the next-to-the-lowermost sheet 104 of the stack 103 because the cam 138 causes the drive 134 to rotate the retaining members 129 to the operative positions shown in FIG. 6*c*.

Immediately or shortly thereafter, the cam 123 of the moving unit 119 reaches an angular position in which the roller follower 124 causes or allows the lever 127 to move the suction heads 106 downwardly (see FIGS. 5*c* or 6*d*) whereby the lowermost sheet 104' becomes separated from the sheet 104 thereabove and its flexure disappears because the surface 106D is sufficiently remote from the opening 128 of the magazine 102 to allow for partial or complete flattening of the sheet 104'. At such time, the suction heads 106 are located in the respective grooves 146 of the conveyor 144 (see FIG. 6*e*) so that the sheet 104' is separated from the surfaces 106A and adheres to the periphery of the conveyor 144. The suction generating means is preferably sealed from the channels 107 as soon as the underside of the sheet 104' reaches the periphery of the conveyor 144 and the aforementioned suction ports in the periphery of the conveyor 144 are simultaneously connected to the suction generating means so that the sheet 104' firmly adheres to and is entrained by the conveyor 144 (see FIG. 6*f*). The outer side of the sheet 104' is thereupon coated with adhesive by the applicator 147 and the sheet is applied to an oncoming pack in a manner not forming part of the invention.

The control means for synchronizing the movements of the drive 134, moving units 108 and 119, and shaft 143 for the conveyor 144 is not shown in the drawing; such control means may be of any suitable design and may include one or more geneva movements for intermittently driven parts and suitable transmission means for all or some of the continuously moving parts Each suction head 106 of the sheet removing device 101 or each element 14 of the sheet removing device 1 may consist of two or more discrete components. Also, it is possible to cause the removing device 1 or 101 to perform movements exactly at right angles to the plane of the next-to-the-lowermost sheet of the stack 3 or 103 (e.g, by replacing the arm 13 or the lever 127 with the reciprocable piston rod of a double-acting hydraulic or pneumatic cylinder and piston unit).

An important advantage of the improved apparatus is that successive lowermost sheets of a stack can be removed even if portions of such sheets are interlaced or interlinked with the next-to-the-lowermost sheets. This insures that the device 1 or 101 invariably removes one sheet at a time and that the removal of lowermost sheets does not entail any damage to or any undesirable shifting of sheets thereabove. Moreover, and when the sheets (4) are formed with fold lines (29 and 31 in FIG. 2), the removal of successive lowermost sheets (4') takes place simultaneously with desirable flexing of sheets along such fold lines to thus facilitate subsequent conversion of sheets into envelopes or the like. Back-and-forth flexing of sheets along the fold lines 29 and 31 enhances the likelihood that the side panels of the outer envelopes of flip-top packs will be formed with a high degree of reproducibility.

A further important advantage of the improved apparatus is that each and every lowermost sheet remains or can remain flat or substantially flat during transfer from the opening of the magazine onto the adjacent conveyor of the packing machine. This insures that the removed sheets must cover a relatively short distance during transport toward the conveyor which, in turn, reduces the likelihood of undesirable shifting of sheets and renders it possible to reduce the space requirements of the apparatus. This is important in cigarette packing and like machines wherein two or more different types of sheets must be withdrawn from discrete magazines.

Without further analysis, the foregoing will so fully reveal the gist of the present invention that others can by applying current knowledge, readily adapt it for various applications without omitting features which fairly constitute essential characteristics of the generic and specific aspects of my contribution of the art and, therefore, such adaptations should and are intended to be comprehended within the meaning and range of equivalence of the claims.

I claim:

1. In an apparatus for removing the lowermost sheet of a stack of superposed sheets, especially a stack of sheets which are to be converted into constituents of containers for smokers' products, a combination comprising a substantially upright magazine having a lower end provided with an opening and being arranged to store a stack of sheets so that the lowermost sheet of the stack therein is adjacent to and can pass downwardly through said opening; a removing device movable substantially at right angles to the planes of sheets in said magazine between a first position in which said device supports the lowermost sheet of the stack in said magazine and a second position, at least the major component of the initial stage of movement of said removing device from said first to said second position being downwardly and substantially at right angles to said planes and said removing device having a first element which supports the lowermost sheet from below in said first position of said device, means for flexing at least one marginal portion of the lowermost sheet of the stack in said magazine to thereby separate said one marginal portion from the next-to-the-lowermost sheet of the stack, and means for maintaining the lowermost sheet in contact with said device during subsequent movement of said device from said first to said second position so that the lowermost sheet becomes fully separated from the next-to-the-lowermost sheet during said initial stage; means for moving said device between said first and second positions; at least one retaining member movable with respect to said magazine to and from an operative position in which a portion of said member supports said one marginal portion of the lowermost sheet from below; and means for transferring sheets from said removing device while said device dwells in said second position, said transferring means comprising at least one tongs pivotable about a fixed axis and said removing device further having an additional element which is movable with respect to said one marginal portion of the lowermost sheet, said additional element having a recess and said tongs having a portion extending into said recess in said second position of said device.

2. A combination as defined in claim 1, wherein said additional element is pivotable with respect to said first element.

3. A combination as defined in claim 2, wherein said additional element is pivotable back and forth through substantially 90° with respect to said first element.

4. A combination as defined in claim 1, wherein said moving means is pivotable with said removing device about an axis which is parallel to the planes of sheets of the stack in said magazine.

5. A combination as defined in claim 1, wherein said maintaining means is at least one suction port in said removing device.

6. A combination as defined in claim 1, further comprising means for pivoting said retaining member to and from said operative position.

7. A combination as defined in claim 1, further comprising conveyor means for sheets, said tongs being movable between said removing device and said conveyor means.

* * * * *